US012281453B2

(12) United States Patent
Gates et al.

(10) Patent No.: US 12,281,453 B2
(45) Date of Patent: Apr. 22, 2025

(54) SNOW PLOW ASSEMBLY

(71) Applicant: Douglas Dynamics, L.L.C., Milwaukee, WI (US)

(72) Inventors: Gatesy R. C. D. Gates, Liberty, ME (US); Andre Valmont Leblond, Rockport, ME (US); Craig D. MacIntosh, Thomaston, ME (US)

(73) Assignee: Douglas Dynamics, L.L.C., Milwaukee, WI (US)

( * ) Notice: Subject to any disclaimer, the term of this patent is extended or adjusted under 35 U.S.C. 154(b) by 735 days.

(21) Appl. No.: 17/499,340

(22) Filed: Oct. 12, 2021

(65) Prior Publication Data

US 2022/0112673 A1 Apr. 14, 2022

Related U.S. Application Data

(60) Provisional application No. 63/090,889, filed on Oct. 13, 2020.

(51) Int. Cl.
*E01H 5/06* (2006.01)

(52) U.S. Cl.
CPC ..... *E01H 5/063* (2013.01); *E01H 5/062* (2013.01)

(58) Field of Classification Search
CPC .. E01H 5/00; E01H 5/06; E01H 5/061; E01H 5/062; E01H 5/063; E01H 5/065; E01H 5/066
See application file for complete search history.

(56) References Cited

U.S. PATENT DOCUMENTS

| | | | | |
|---|---|---|---|---|
| 4,907,358 | A | 3/1990 | Moore | |
| 5,036,662 | A | 8/1991 | Knowlton | |
| 5,245,771 | A | 9/1993 | Walsh | |
| 5,974,702 | A * | 11/1999 | Donoghue | E01H 5/06 37/234 |
| 6,006,390 | A | 12/1999 | Bischel et al. | |
| 6,269,557 | B1 | 8/2001 | Henks | |
| 6,286,236 | B1 | 9/2001 | Bowers | |
| 6,334,269 | B1 | 1/2002 | Dilks | |

(Continued)

*Primary Examiner* — Thomas B Will
*Assistant Examiner* — Robert E Pezzuto
(74) *Attorney, Agent, or Firm* — Wood Herron & Evans LLP

(57) ABSTRACT

A snow plow assembly comprises an angle frame adapted to be operably mounted to a vehicle, a quadrant frame, a plow blade mounted to the quadrant frame, a drive link pivotally connected to the angle frame and the quadrant frame at first and second pivot points, respectively, a swing link pivotally connected to the angle frame and the quadrant frame at third and fourth pivot points, respectively, the angle frame, quadrant frame, drive link, and swing link, and the first, second, third, and fourth pivot points defining a four-bar linkage, and a first actuator pivotally connected on one end to the angle frame at a fifth pivot point and pivotally connected on the other end to the drive link at a sixth pivot point, wherein extending the first actuator causes the quadrant frame and hence the plow blade to rotate in a first direction from a neutral position generally perpendicular to a longitudinal axis of the vehicle, and retracting the first actuator causes the quadrant frame and hence the plow blade to rotate in a second opposite direction from the neutral position.

25 Claims, 16 Drawing Sheets

(56) References Cited

U.S. PATENT DOCUMENTS

| | | | |
|---|---|---|---|
| 6,502,334 | B1 | 1/2003 | Davies |
| 6,732,811 | B1 | 5/2004 | Elliott |
| 6,843,002 | B1 | 1/2005 | Moffitt |
| 6,874,582 | B2 | 4/2005 | Hollinrake et al. |
| 6,925,735 | B2 | 8/2005 | Hamm et al. |
| 6,957,505 | B1 | 10/2005 | Moffitt |
| 6,964,121 | B2 | 11/2005 | Harris |
| 7,063,169 | B2 | 6/2006 | Elliott |
| 7,093,381 | B2 | 8/2006 | Belzile |
| 7,219,453 | B2 | 5/2007 | Baker |
| 7,419,011 | B2 | 9/2008 | Curtis et al. |
| 7,426,795 | B2 | 9/2008 | Raddon |
| 7,849,614 | B2 | 12/2010 | Belzile et al. |
| 7,975,407 | B2 | 7/2011 | Dilworth et al. |
| 7,997,015 | B2 | 8/2011 | Belzile et al. |
| 8,019,515 | B2 | 9/2011 | Okeson et al. |
| 8,151,493 | B2 | 4/2012 | Dilworth et al. |
| 8,342,540 | B1 * | 1/2013 | Marleau ..... E01H 5/063 280/5.513 |
| 8,381,422 | B2 | 2/2013 | Hill |
| 8,505,973 | B2 | 8/2013 | Hill |
| 8,578,635 | B2 | 11/2013 | Hill |
| 8,656,615 | B1 | 2/2014 | Fournier et al. |
| 8,695,238 | B2 | 4/2014 | Warchola et al. |
| 8,739,436 | B2 | 6/2014 | Hill |
| 8,763,280 | B1 | 7/2014 | Fournier et al. |
| 8,769,847 | B2 | 7/2014 | Coulombe et al. |
| 10,472,783 | B2 | 11/2019 | Rich |
| 2004/0016220 | A1 | 1/2004 | Conley |
| 2004/0045726 | A1 | 3/2004 | Hollinrake et al. |
| 2005/0166428 | A1 | 8/2005 | Hollinrake et al. |
| 2007/0084089 | A1 * | 4/2007 | Shoemaker ..... E01H 5/06 37/231 |
| 2018/0143634 | A1 | 5/2018 | Ott et al. |

* cited by examiner

SNOW PLOW ASSEMBLY

RELATED APPLICATIONS

This application claims the priority benefit of U.S. Provisional Patent Application No. 63/090,889 filed Oct. 13, 2020, the entire substance of which is hereby incorporated by reference herein as if fully set forth in its entirety.

FIELD OF THE INVENTION

This invention relates generally to snow plows, and more particularly to snow plows that are particularly suited for mounting to, and operation by, all terrain vehicles (ATV's) and utility terrain vehicles (UTV's).

BACKGROUND OF THE INVENTION

One conventional vehicle mounted snow plow assembly has a lift frame (or head gear) removably mounted to the vehicle, an A-frame pivotally connected at its aft end to the lift frame for pivoting about a generally horizontal axis generally transverse to the longitudinal axis of the vehicle, and a straight plow blade pivotally connected to the A-frame at its forward end for pivoting about a generally vertical axis. A hydraulic cylinder is mounted to the lift frame and A-frame to raise and lower the plow blade. Additional hydraulic cylinders are mounted to the A-frame and the plow blade to pivot or angle the plow blade to the right (clockwise when viewed from above) and to the left (counterclockwise when viewed from above), depending on the direction the operator wants to throw the snow.

Straight blade snow plows tend to shift their scraping edges away from the longitudinal center line of the plowing vehicle when the blade is angled. This shift is due to the customary design of having a fixed pivot point usually defined by a pivot pin that is rearward of the scraping edge of the plow blade. The lateral shift induced by this design necessitates using a plow blade that is longer than otherwise needed to cover the wheel width of the plowing vehicle in order to ensure that snow is cleared from in front of both front wheels.

Using a plow blade that is longer than otherwise needed, i.e. using a plow blade of customary geometry, creates unwanted performance issues. For example, a longer plow blade is more expensive to manufacture. A longer plow blade is heavier, which can lead to deleterious wear effects on the plowing vehicle and the rest of the components of the plow assembly. A heavier plow blade also requires more energy to raise and lower and to angle right and left. Use of a longer plow blade results in the potential for one wheel of the plowing vehicle to be traveling over and packing down unplowed snow. A longer plow blade results in the need to offset the vehicle's travel path laterally to maintain an angled plow blade's track down the middle of a narrow street or road, which can result in the plowing vehicle's wheels leaving the pavement.

Accordingly, there is a need for a snow plow assembly that overcomes these and other deficiencies of conventional vehicle mounted straight blade snow plow assemblies.

SUMMARY OF THE INVENTION

In one aspect, a snow plow assembly comprises an angle frame adapted to be operably mounted to a vehicle, a quadrant frame, a plow blade mounted to the quadrant frame, a drive link pivotally connected to the angle frame and the quadrant frame at first and second pivot points, respectively, a swing link pivotally connected to the angle frame and the quadrant frame at third and fourth pivot points, respectively, the angle frame, quadrant frame, drive link, and swing link, and the first, second, third, and fourth pivot points defining a four-bar linkage, and a first actuator pivotally connected on one end to the angle frame at a fifth pivot point and pivotally connected on the other end to the drive link at a sixth pivot point, wherein extending the first actuator causes the quadrant frame and hence the plow blade to rotate in a first direction from a neutral position generally perpendicular to a longitudinal axis of the vehicle, and retracting the first actuator causes the quadrant frame and hence the plow blade to rotate in a second opposite direction from the neutral position.

Extending the first actuator can also cause the quadrant frame and hence the plow blade to translate in a first direction generally transverse to the longitudinal axis of the vehicle, and retracting the first actuator can also cause the quadrant frame and hence the plow blade to translate in a second opposite direction generally transverse to the longitudinal axis of the vehicle. For example, extending the first actuator can cause the quadrant frame and hence the plow blade to rotate counter-clockwise from the neutral position when viewed from above, and retracting the first actuator can cause the quadrant frame and hence the plow blade to rotate clockwise from the neutral position when viewed from above, and extending the first actuator can also cause the quadrant frame and hence the plow blade to translate to the right when viewed from above, and retracting the first actuator can also cause the quadrant frame and hence the plow blade to translate to the left when viewed from above.

The angle frame, quadrant frame, drive link, and swing link, and the first, second, third, and fourth pivot points can define a trapezoid when the quadrant frame and hence the plow blade are in the neutral position. The fifth and sixth pivot points can be located outside a perimeter of the trapezoid. The fifth and sixth pivot points can be located rearward of the first and third pivot points. The drive link can include a portion extending rearward from the first pivot point to the sixth pivot point.

The assembly can further comprise a head gear adapted to be removably connected to the vehicle, the angle frame pivotally connected to the head gear for pivoting movement about a generally horizontal axis generally perpendicular to the longitudinal axis of the vehicle, and a second actuator operably connected to the head gear and the angle frame for raising and lowering the plow blade.

The first actuator can be a double acting hydraulic cylinder, and the second actuator can be a single acting hydraulic cylinder.

The vehicle can be an ATV or a UTV.

In another aspect, a snow plow assembly comprises an angle frame adapted to be operably mounted to a vehicle, a quadrant frame, a plow blade mounted to the quadrant frame, a first link pivotally connected to the angle frame and the quadrant frame at first and second pivot points, respectively, a second link pivotally connected to the angle frame and the quadrant frame at third and fourth pivot points, respectively, the angle frame, quadrant frame, first link, and second link, and the first, second, third, and fourth pivot points defining a four-bar linkage, the first link being pivotably fixable relative to the angle frame at least a first position, a second position, and a third position, wherein when the first link pivots from the first position to the second position relative to the angle frame the quadrant frame and hence the plow blade rotate in a first direction from a neutral position generally perpendicular to a longitudinal axis of the vehicle, and when the first link pivots from the first position to the third position the quadrant frame and hence the plow blade rotate in a second opposite direction from the neutral position.

When the first link pivots from the first position to the second position the quadrant frame and hence the plow blade can also translate in a first direction generally transverse to the longitudinal axis of the vehicle, and when the first link pivots from the first position to the third position the quadrant frame and hence the plow blade can also translate in a second opposite direction generally transverse to the longitudinal axis of the vehicle. For example, when the first link pivots from the first position to the second position the quadrant frame and hence the plow blade can rotate counter-clockwise from the neutral position when viewed from above, and when the first link pivots from the first position to the third position the quadrant frame and hence the plow blade rotate clockwise from the neutral position when viewed from above, and when the first link pivots from the first position to the second position the quadrant frame and hence the plow blade can also translate to the right when viewed from above, and when the first link pivots from the first position to the third position the quadrant frame and hence the plow blade can also translate to the left when viewed from above.

The angle frame, quadrant frame, first link, and second link, and the first, second, third, and fourth pivot points can define a trapezoid when the quadrant frame and hence the plow blade are in the neutral position. The first link can be pivotably fixable relative to the angle frame at a location outside a perimeter of the trapezoid. The location can be located rearward of the first and third pivot points. The first link can include a portion extending rearward from the first pivot point to the location.

The assembly can further comprise a head gear adapted to be removably connected to the vehicle, the angle frame pivotally connected to the head gear for pivoting movement about a generally horizontal axis generally perpendicular to the longitudinal axis of the vehicle, and an actuator operably connected to the head gear and the angle frame for raising and lowering the plow blade. The actuator can be a winch adapted to be mounted to the vehicle, the winch having a cable with a free end, the free end being connected to the angle frame, and the head gear having a pulley rotatably supporting the cable.

In yet another aspect, a snow plow assembly comprises an angle frame adapted to be operably mounted to a vehicle, a quadrant frame, a plow blade mounted to the quadrant frame, a first link pivotally connected to the angle frame and the quadrant frame at first and second pivot points, respectively, a second link pivotally connected to the angle frame and the quadrant frame at third and fourth pivot points, respectively, the angle frame, quadrant frame, first link, and second link, and the first, second, third, and fourth pivot points defining a four-bar linkage, the first link being pivotably fixable relative to the angle frame at a first position, a second position, and a third position, first means for pivoting the plow blade, quadrant frame, first link, and second link relative to the angle frame, wherein when the first link pivots from the first position to the second position relative to the angle frame the quadrant frame and hence the plow blade rotate in a first direction from a neutral position generally perpendicular to a longitudinal axis of the vehicle, and when the first link pivots from the first position to the third position the quadrant frame and hence the plow blade rotate in a second opposite direction from the neutral position, wherein when the first link pivots from the first position to the second position the quadrant frame and hence the plow blade translate in a first direction generally transverse to the longitudinal axis of the vehicle, and when the first link pivots from the first position to the third position the quadrant frame and hence the plow blade translate in a second opposite direction generally transverse to the longitudinal axis of the vehicle, a head gear adapted to be removably connected to the vehicle, the angle frame pivotally connected to the head gear for pivoting movement about a generally horizontal axis generally perpendicular to the longitudinal axis of the vehicle, and second means operably connected to the head gear and the angle frame for raising and lowering the plow blade.

The first means can be a double acting hydraulic cylinder and the second means can be a single acting hydraulic cylinder. Alternatively, the first means can be manual by an operator and the second means can be a cable winch adapted to be mounted to the vehicle.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
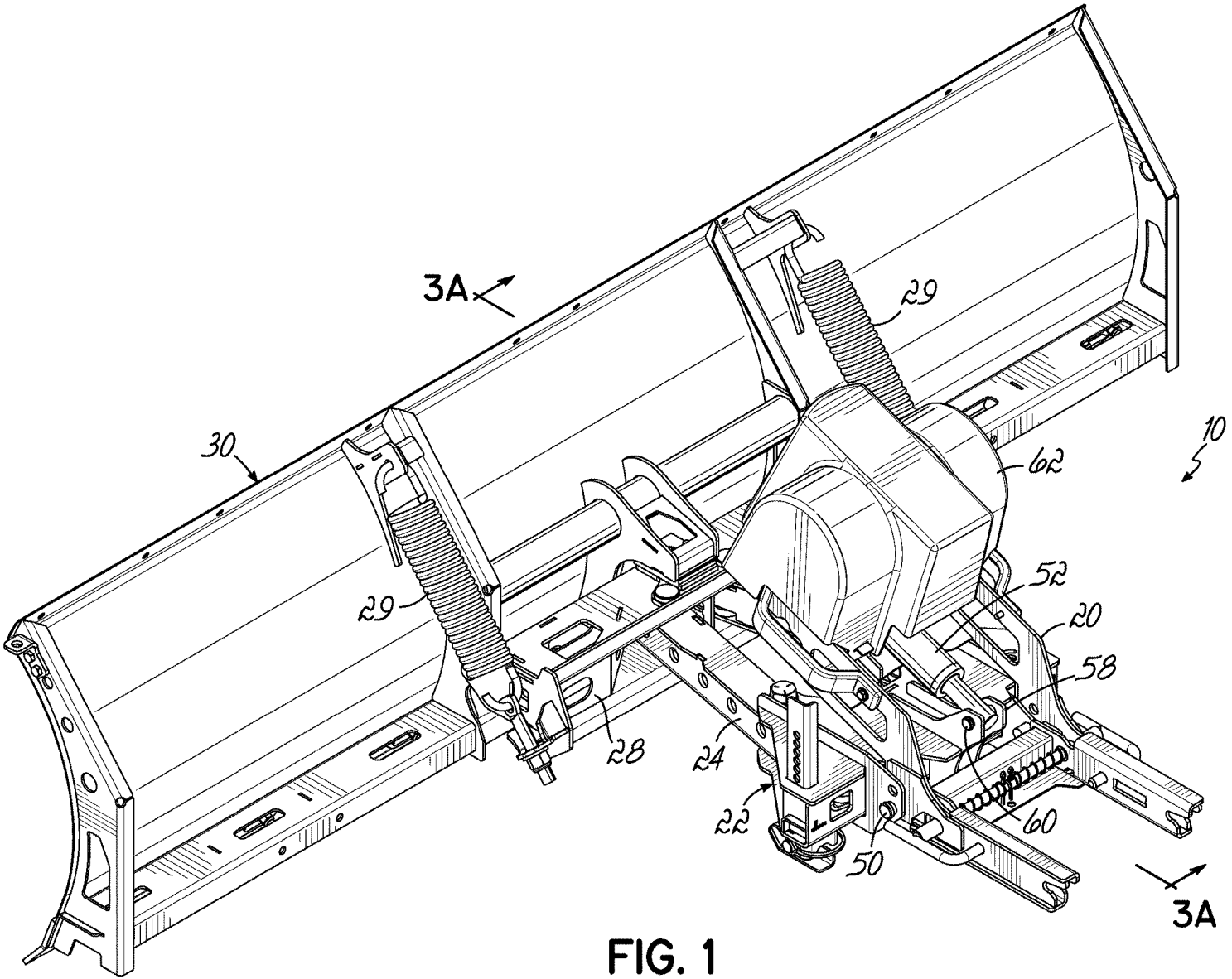
FIG. 1 is a rear, top, left side perspective view of a snow plow assembly embodying the principles of the present invention.
Figure 2:
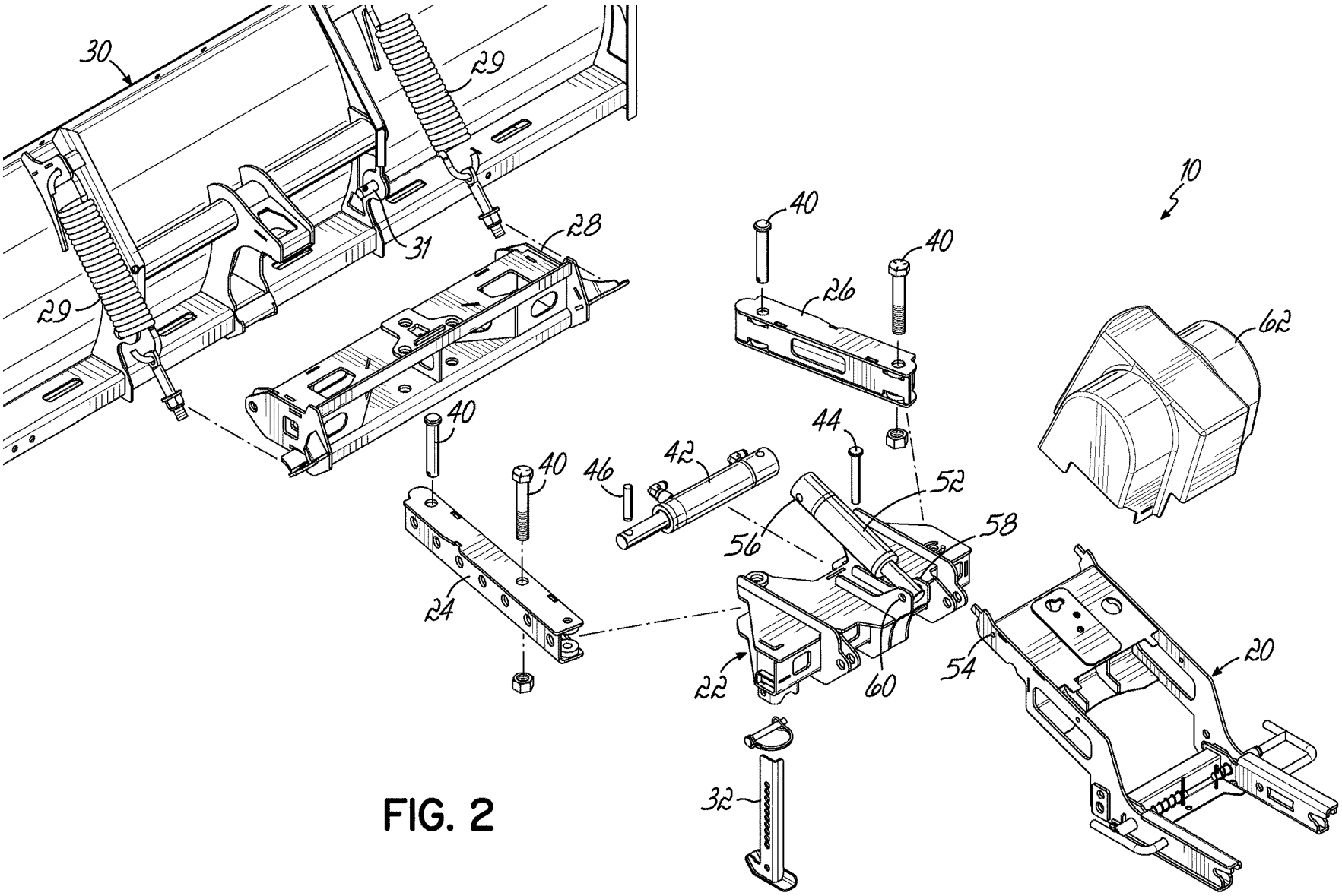
FIG. 2 is an exploded perspective view thereof.

Referring first to FIGS. 1 and 2, there is illustrated a snow plow assembly 10 according to the principles of the present invention. The assembly 10 comprises, generally, a head gear 20, an angle frame 22, a first or drive link 24, a second or swing link 26, quadrant frame or push beam 28, and a plow blade 30.

Referring to FIGS. 2 and 4A-4C, the plow blade 30 is pivotally mounted to the quadrant frame 28 about a generally horizontal pivot axis generally transverse to the longitudinal axis of the vehicle via pins 31. The lower edge (cutting edge) of the plow blade is spring biased forwardly via tension springs 29. The assembly 10 is thereby equipped with a blade trip function for when the blade 30 encounters obstacles during plowing.

Figure 5:
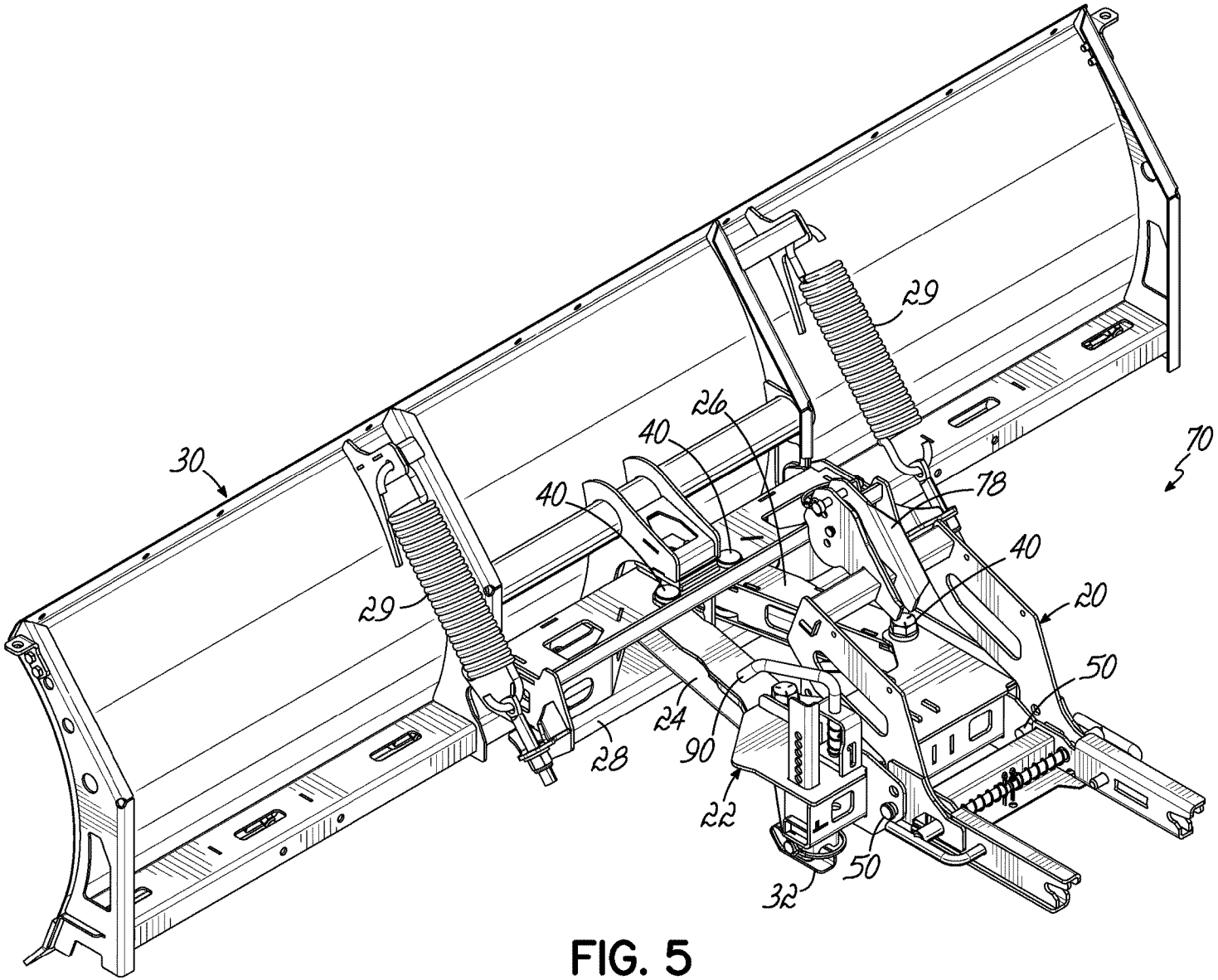
FIG. 5 is a rear, top, left side perspective view of an alternative embodiment of a snow plow assembly embodying the principles of the present invention.
Figure 6:
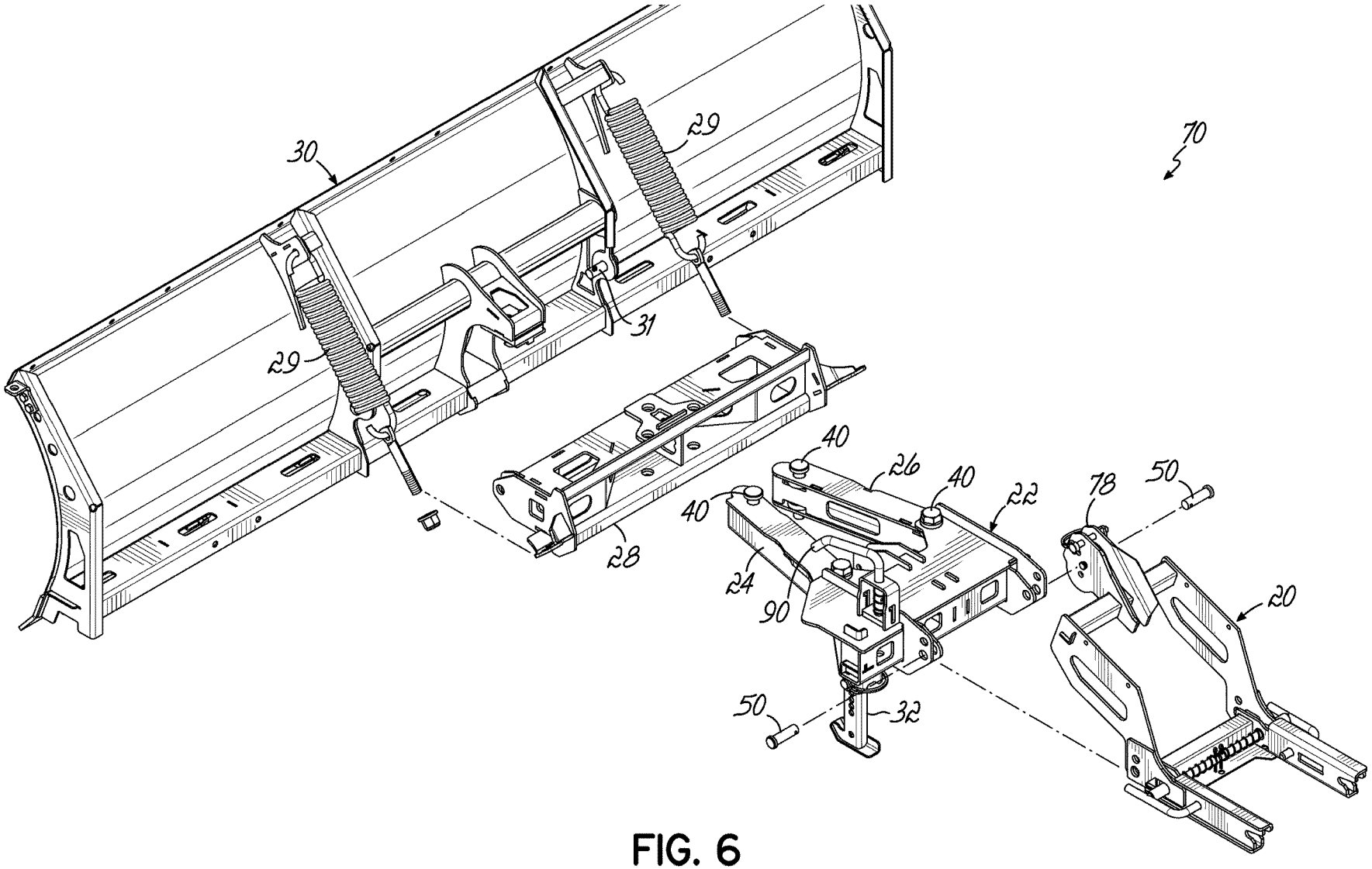
FIG. 6 is an exploded perspective view thereof.
Figure 7:
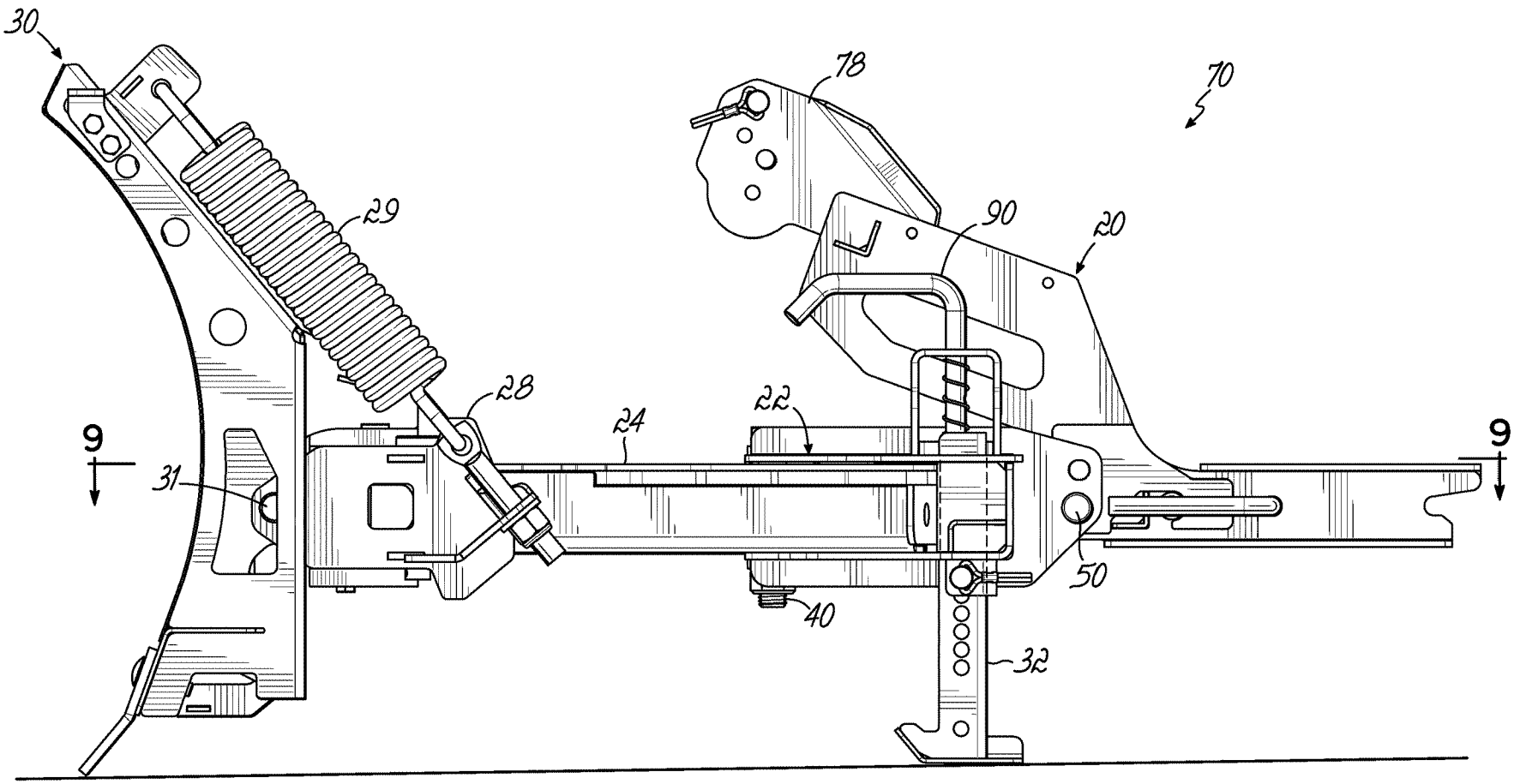
FIG. 7 is a side view with the plow blade lowered.
Figure 8:
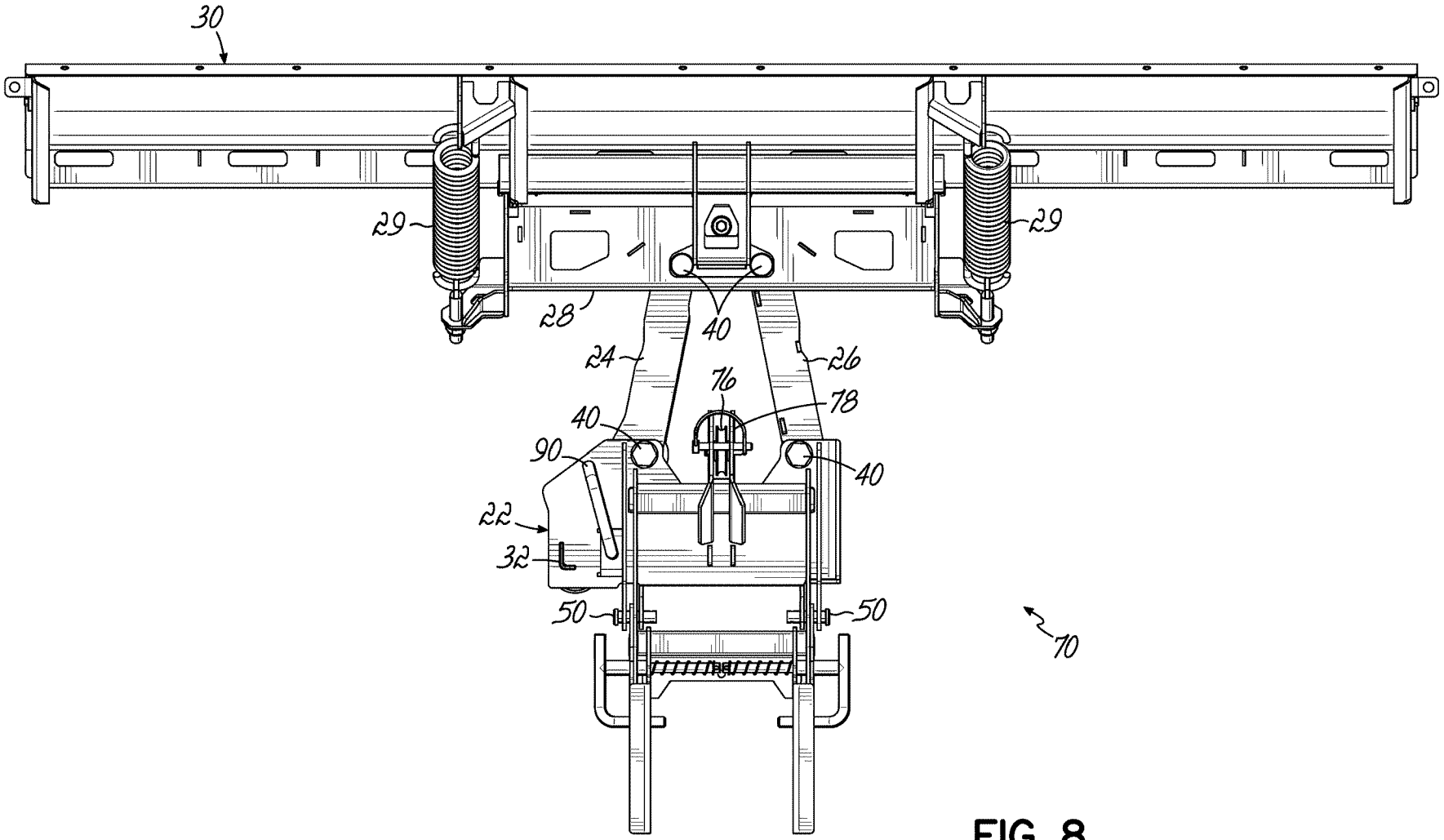
FIG. 8 is a top view with the plow blade in the neutral position.
Figure 9:
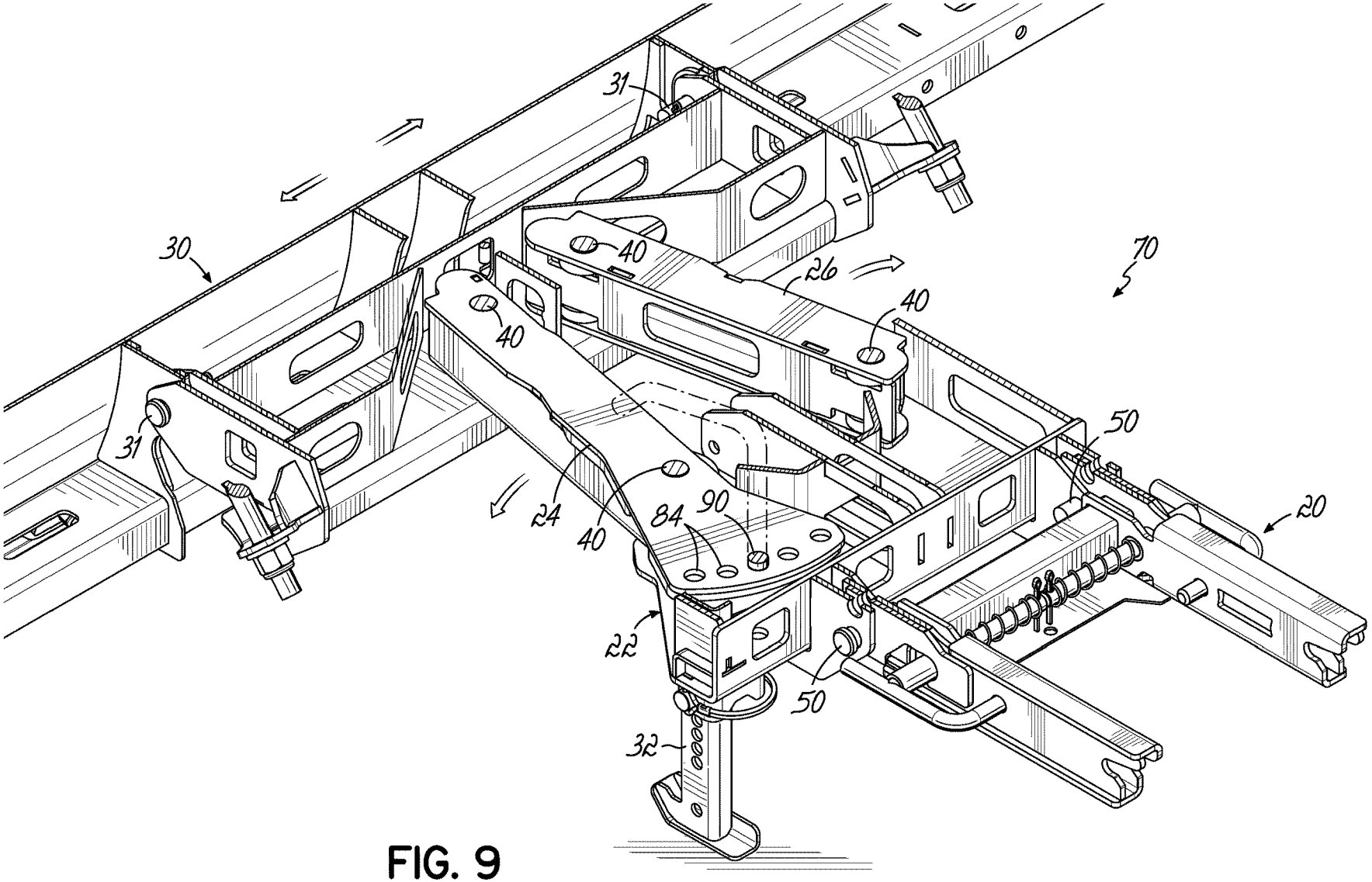
FIG. 9 is an isometric cross-sectional view taken along line 9-9 in FIG. 7.
Figure 11:
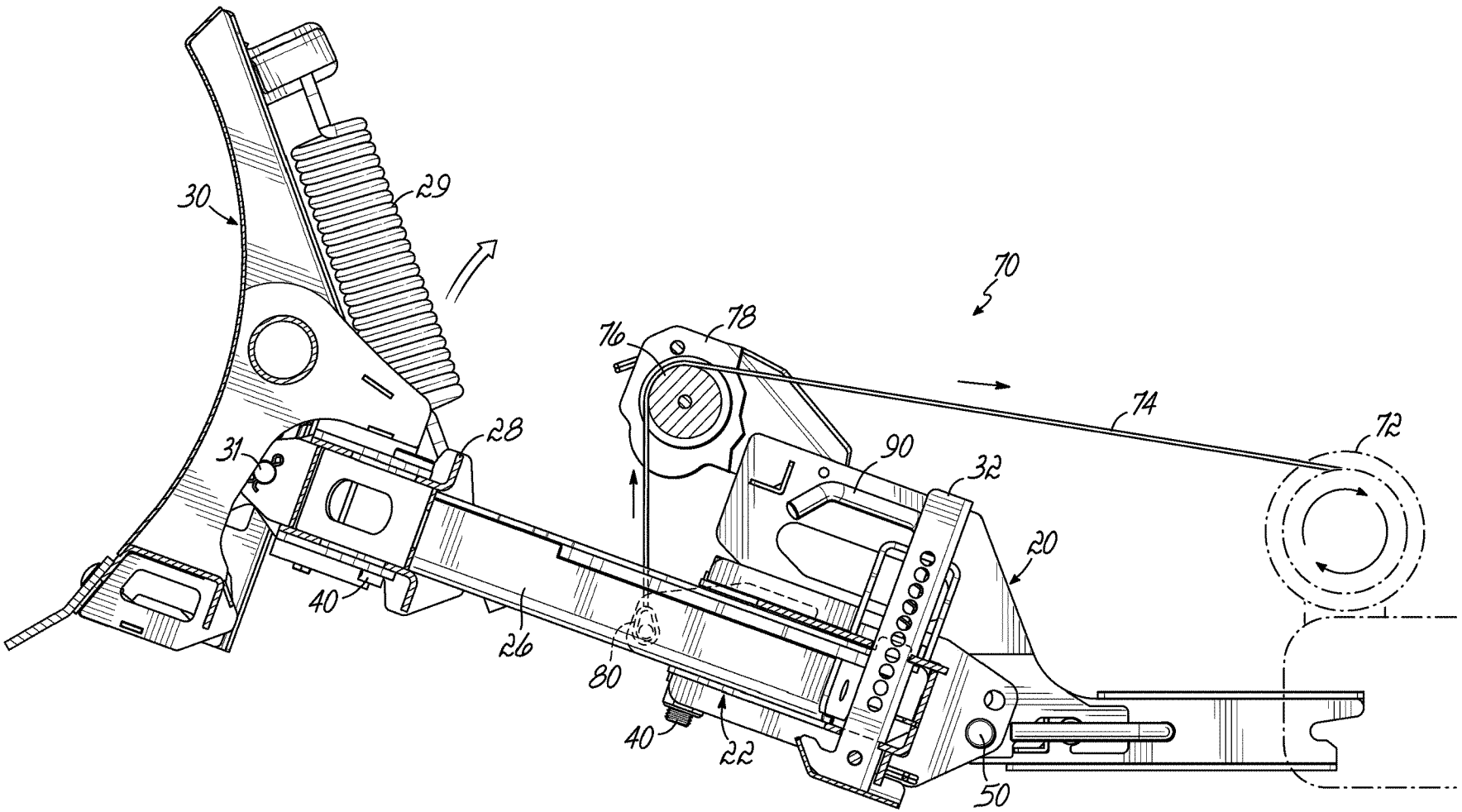
FIG. 11 is a side cross-sectional view with the plow blade raised.

Angle frame 22 includes a raisable and lowerable jack stand 32 to support the assembly 10 when removed from a vehicle (shown retracted in FIGS. 1, 5, and 11; shown extended in FIGS. 6, 7, and 9).

Figure 4A:
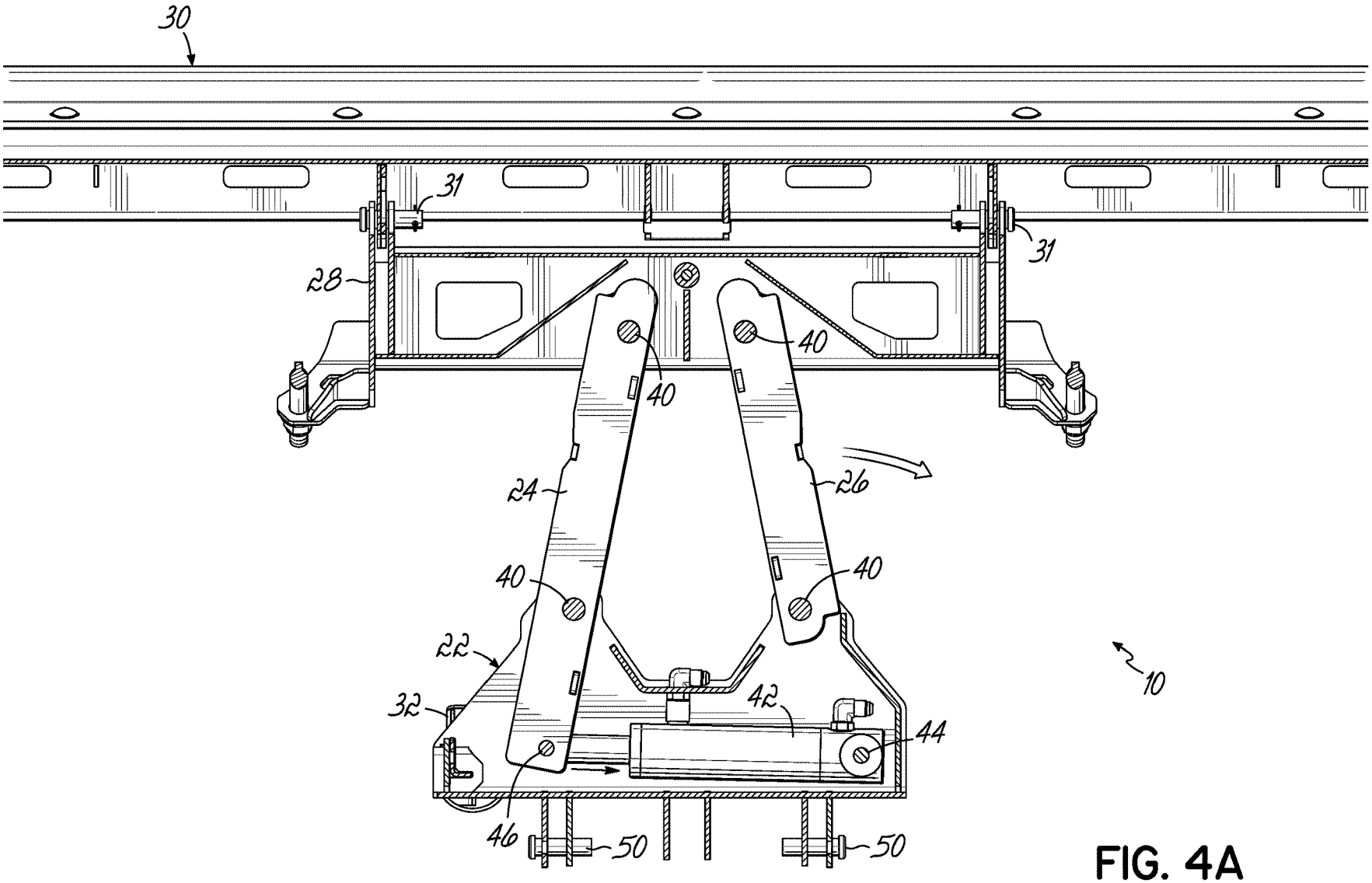
FIG. 4A is a cross-sectional view taken along line 4A-4A in FIG. 3A.
Figure 4B:
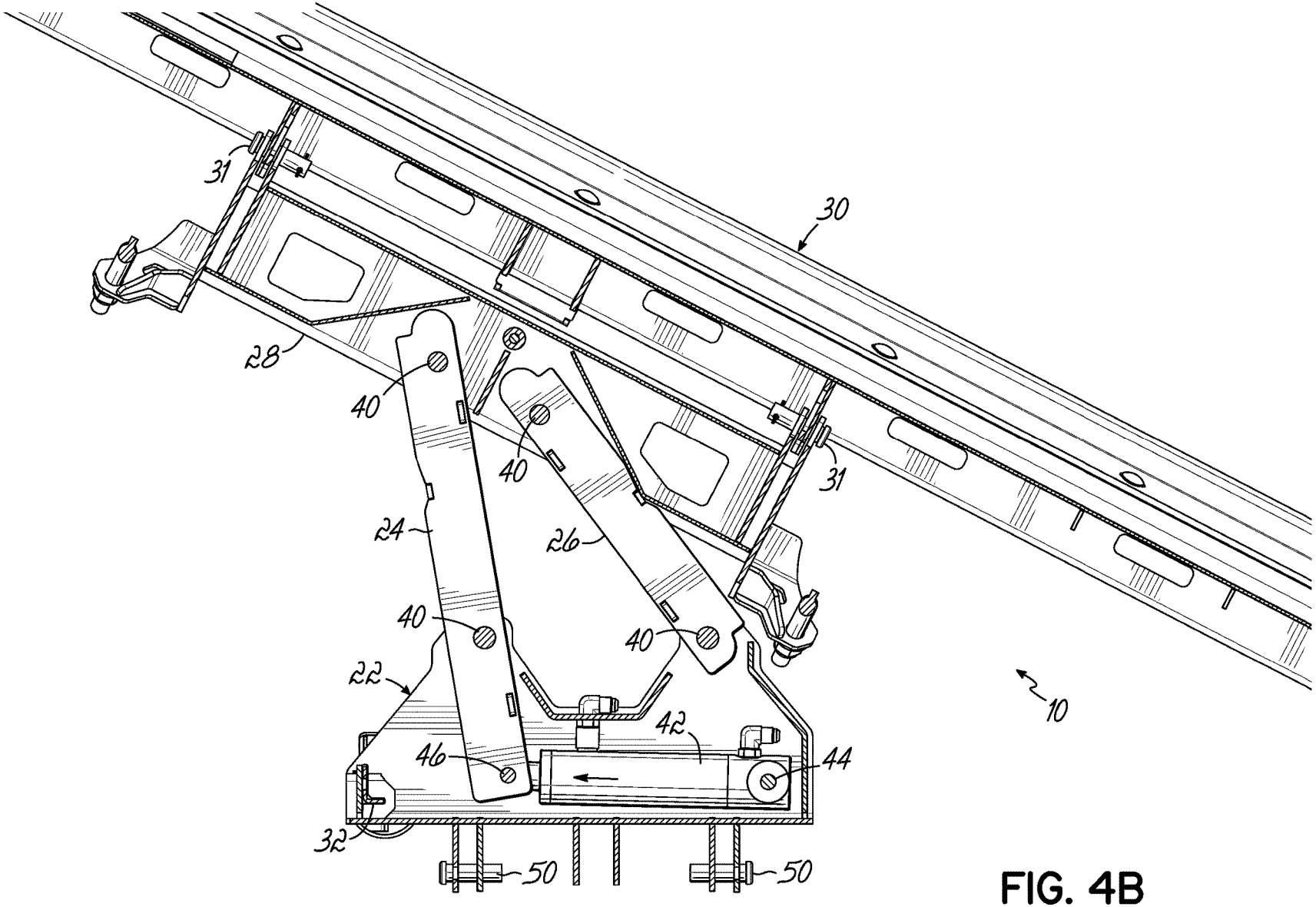
FIG. 4B is a view similar to FIG. 4A with the plow blade rotated clockwise to the right.
Figure 4C:
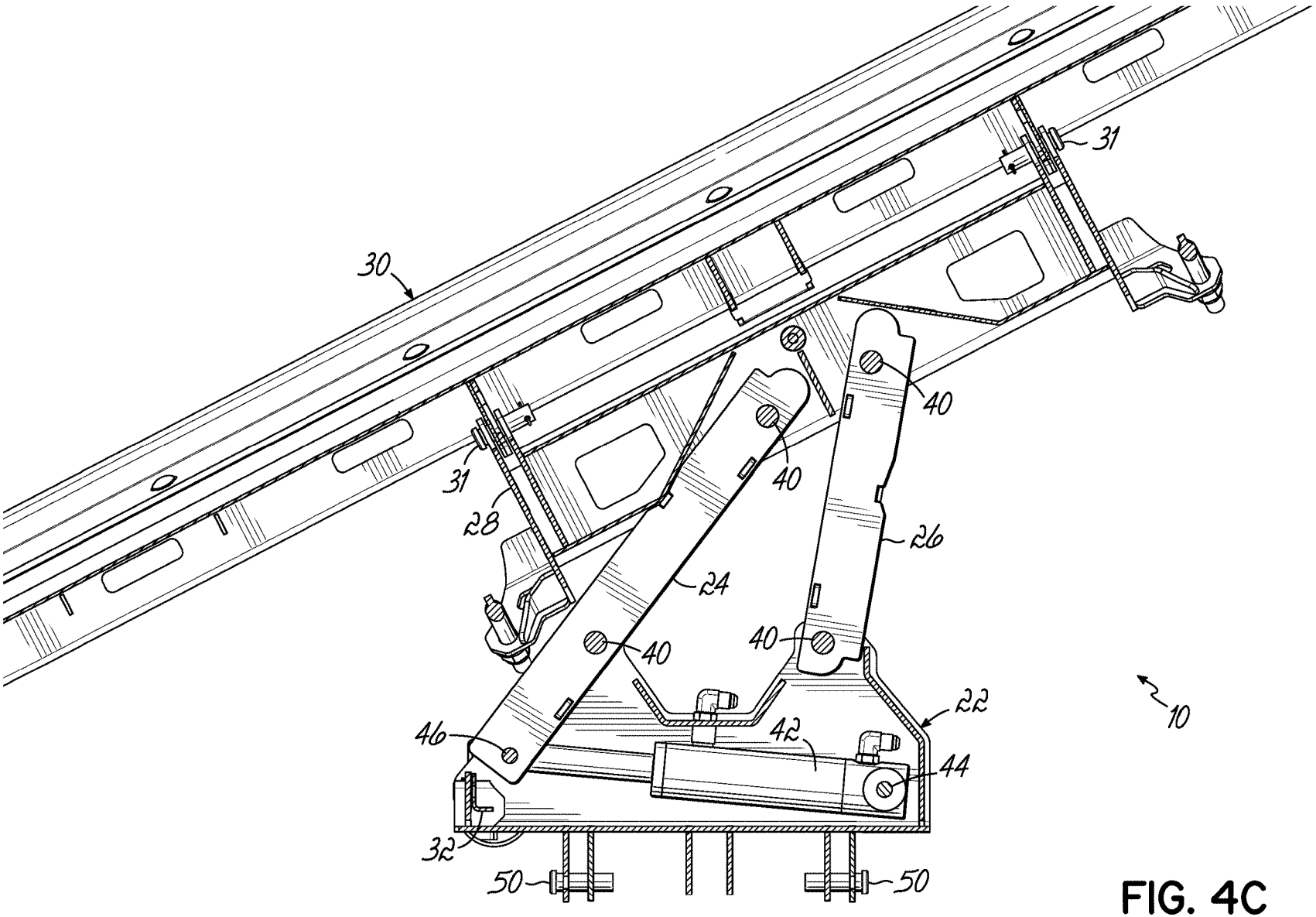
FIG. 4C is a view similar to FIG. 4B with the plow blade rotated counterclockwise to the left.

First or drive link 24 and second or swing link 26 are pivotally connected to the angle frame 22 and quadrant frame 28 with pins or bolts/nuts 40. A double acting hydraulic cylinder 42 has its cylinder end pivoted to angle frame 22 with pin 44 and its rod end pivoted to drive link 24 with pin 46. The geometry of the angle frame 22, drive link 24, swing link 26, quadrant frame 28 and pivot pins/bolts 40 is such that retraction of cylinder 42 rotates plow blade 30 clockwise to the right as shown in FIG. 4B. At the same, the plow blade 30 is counter-translated to the left. Similarly, as shown in FIG. 4C, extension of cylinder 42 rotates plow blade 30 counterclockwise to the left, and at the same time the plow blade 30 is counter-translated to the right. The four-bar linkage that is the angle frame 22, drive link 24, swing link 26, and quadrant frame 28, thereby maintains the plow blade 30 centered with respect to the vehicle centerline when angling the plow blade to the right and to the left.

Figure 3A:
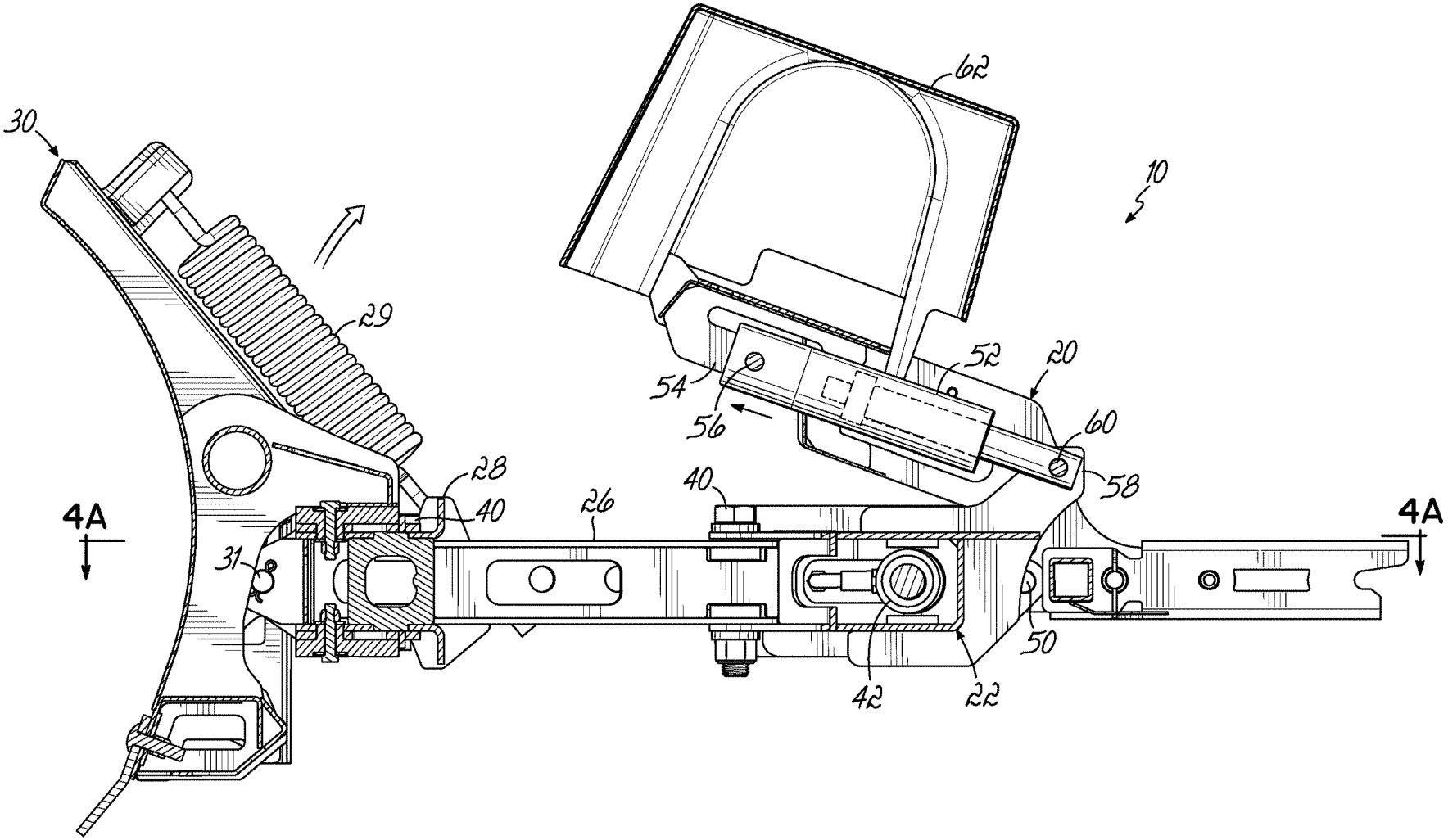
FIG. 3A is a cross-sectional view taken along line 3A-3A in FIG. 1 with the plow blade lowered.
Figure 3B:
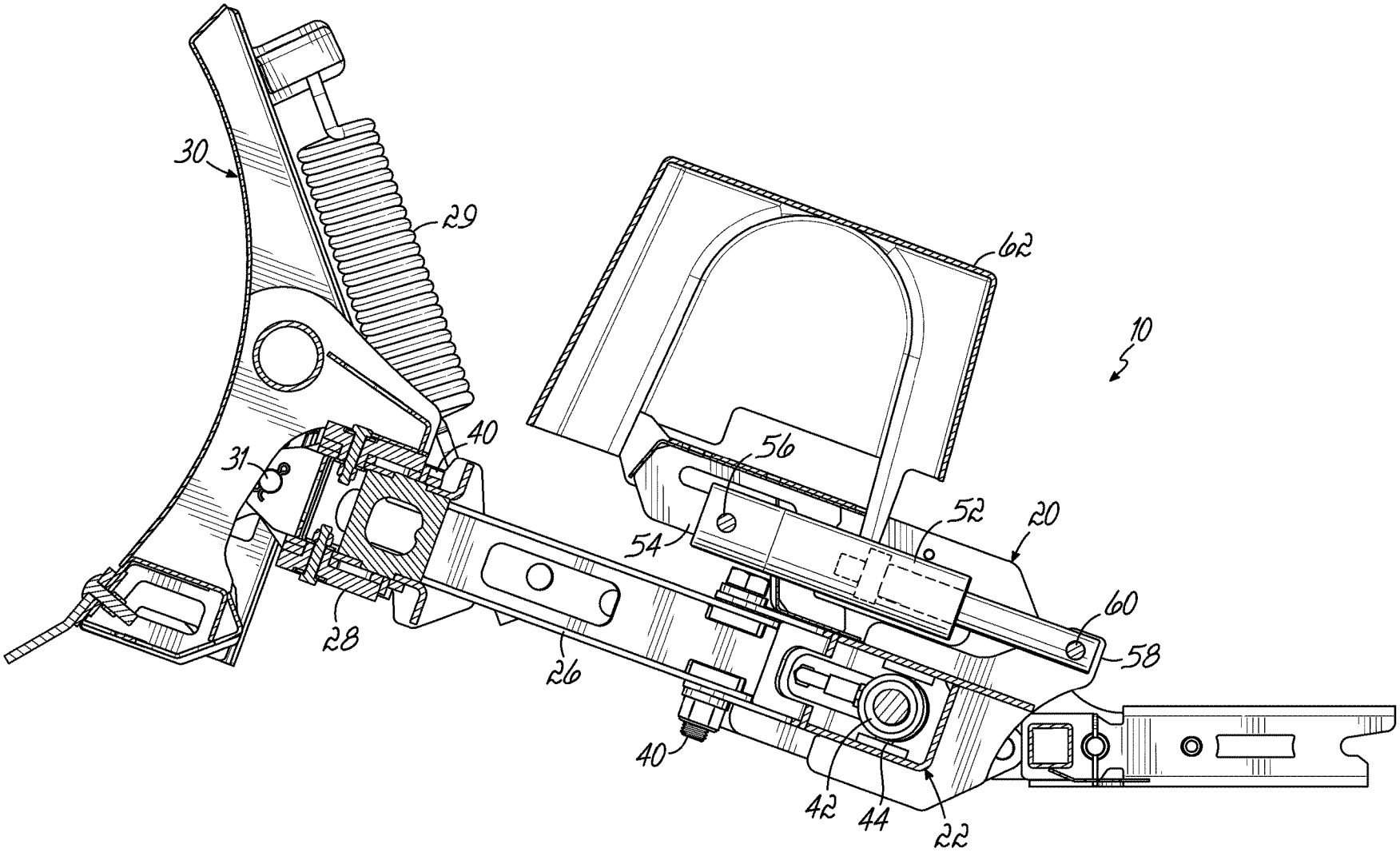
FIG. 3B is a view similar to FIG. 3A with the plow blade raised.

Referring now to FIGS. 2, 3A, and 3B, head gear 20 is adapted to be connected to a vehicle mount (not shown) attached to a vehicle, be it an ATV, UTV, pickup truck, or other vehicle. The angle frame 22 is pivotally connected to the head gear 20 by means of horizontal pins 50 at the rear of the angle frame 22. These pins 50 define a generally horizontal pivot axis generally transverse to the longitudinal axis of the vehicle for raising the plow blade 30 (FIG. 3B) and lowering the plow blade 30 (FIG. 3A).

A single acting hydraulic cylinder 52 has its cylinder end attached to an attachment point 54 near the front end of the head gear 20 with a pin 56, and has its rod end attached to an attachment point 58 near the aft end of the angle frame 22 above and aft of the pins 50 with a pin 60. Extension of cylinder 52 raises the plow blade 30 (FIG. 3B); retraction of cylinder 52 and lowers the plow blade (FIG. 3A). A shroud or housing 62 is mounted to the head gear 20 and houses the hydraulic pump and associated componentry for the hydraulic cylinders 42 and 52.

Referring now to FIGS. 5-11, there is illustrated an alternative embodiment of plow assembly 70 according to the principles of the present invention. With like numbers representing like elements in the previous embodiment, this embodiment eliminates both hydraulic cylinders 42 and 52. In the place of cylinder 52 (lift cylinder), this embodiment utilizes a cable winch 72 mounted on the vehicle to lift and lower the plow blade 30. The cable 74 of the winch 72 passes over a pully 76 rotatably supported on a pully mount 78 attached to the head gear 20. The free end of the cable 74 is connected to the angle frame 22 at 80. Winding in the cable 74 with winch 72 raises the plow blade 30; paying out the cable 74 with the winch 72 lowers the plow blade 30.

The means for angling the plow blade 30 to the right and left is accomplished manually by an operator. The aft end of first link 24 includes a plurality of holes 84 alignable with a hole 86 (FIG. 10A) in angle frame 22. Five such holes 84 are illustrated, providing a neural position for the plow blade 30, two angled right positions for the plow blade 30, and two angled left positions for the plow blade 30. More than five such holes 84 or less than five such holes 84 can of course be utilized.

Figure 10A:
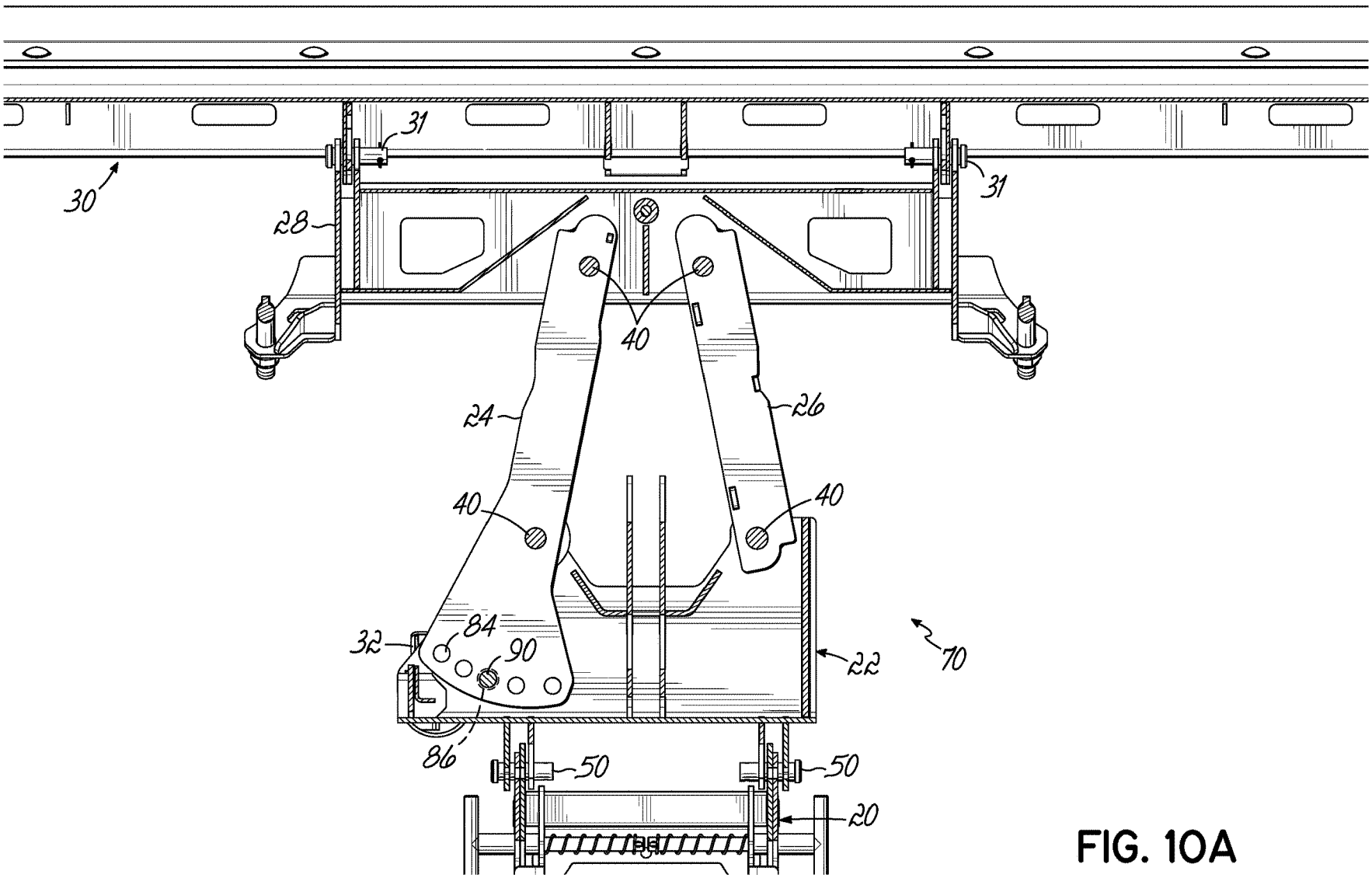
FIG. 10A is a top cross-sectional view with the plow blade in the neutral position.
Figure 10B:
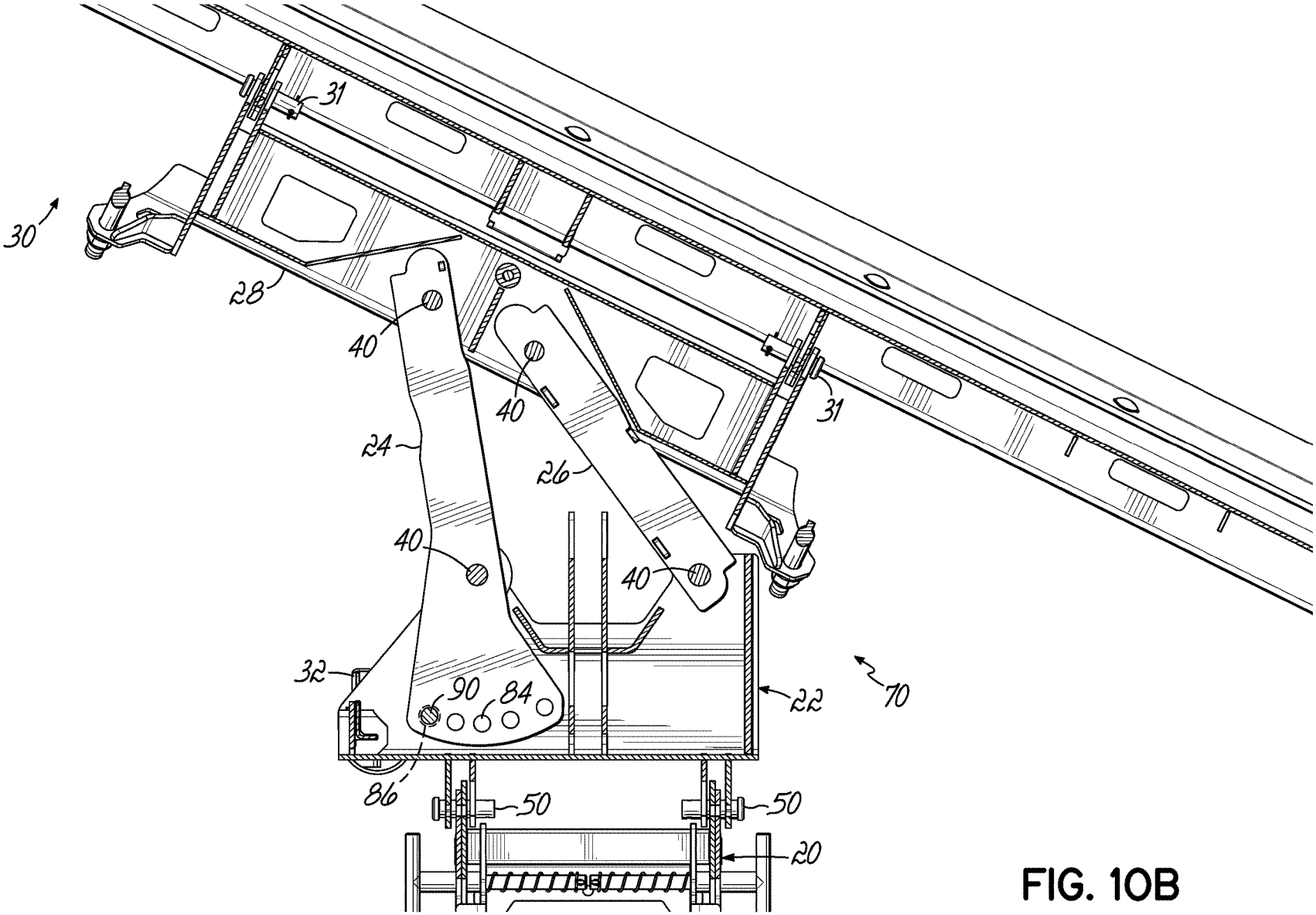
FIG. 10B is a top cross-sectional view with the plow blade rotated clockwise to the right.
Figure 10C:
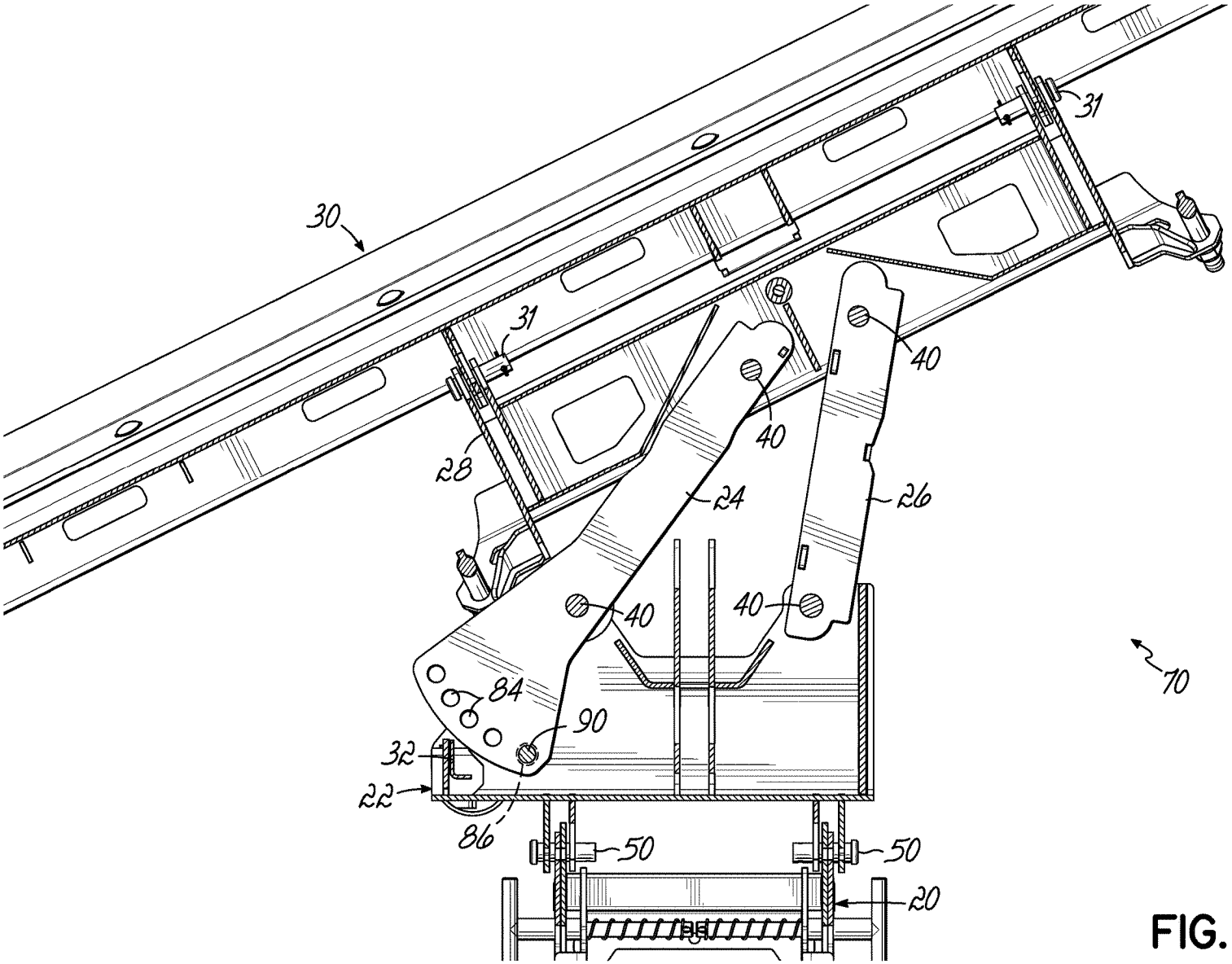
FIG. 10C is a top cross-sectional view with the plow blade rotated counterclockwise to the left.

The plow blade 30 is positioned in its various positions as follows: An operator grasps the plow blade 30 and manually physically angles the plow blade 30 from the neural position to the desired angled position. A pin 90, spring biased downwardly to a latched position, is passed through the aligned holes 84, 86 in the link 24 and the angle frame 22 to latch the plow blade 30 in the desired position. As in the prior embodiment, the four-bar linkage that is the angle frame 22, first link 24, second link 26, and quadrant frame 28, thereby maintains the plow blade 30 centered with respect to the vehicle centerline when angling the plow blade to the right (FIG. 10B) and to the left (FIG. 10A).

While the snow plow assembly of the present invention has particular application for use on ATV's and UTV's, it could be used on other vehicles as well. Accordingly, the invention is not limited to ATV's and UTV's.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A snow plow assembly comprising:

an angle frame adapted to be operably mounted to a vehicle, a quadrant frame, a plow blade mounted to said quadrant frame, a drive link pivotally connected to said angle frame and said quadrant frame at first and second pivot points, respectively, a swing link pivotally connected to said angle frame and said quadrant frame at third and fourth pivot points, respectively, said angle frame, quadrant frame, drive link, and swing link, and said first, second, third, and fourth pivot points defining a four-bar linkage, and a first actuator pivotally connected on one end to said angle frame at a fifth pivot point and pivotally connected on the other end to said drive link at a sixth pivot point, wherein extending said first actuator causes said quadrant frame and hence said plow blade to rotate in a first direction from a neutral position generally perpendicular to a longitudinal axis of the vehicle, and retracting said first actuator causes said quadrant frame and hence said plow blade to rotate in a second opposite direction from the neutral position, wherein said angle frame, quadrant frame, drive link, and swing link, and said first, second, third, and fourth pivot points define a trapezoid when said quadrant frame and hence said plow blade are in the neutral position, wherein at least one of said fifth and sixth pivot points is located outside a perimeter of the trapezoid, wherein said at least one of said fifth and sixth pivot points is located rearward of said first and third pivot points.

2. The assembly of claim 1 wherein:

extending said first actuator also causes said quadrant frame and hence said plow blade to translate in a first direction generally transverse to the longitudinal axis of the vehicle, and retracting said first actuator also causes said quadrant frame and hence said plow blade to translate in a second opposite direction generally transverse to the longitudinal axis of the vehicle.

3. The assembly of claim 2 wherein:

extending said first actuator causes said quadrant frame and hence said plow blade to rotate counter-clockwise from the neutral position when viewed from above, and retracting said first actuator causes said quadrant frame and hence said plow blade to rotate clockwise from the neutral position when viewed from above, and extending said first actuator also causes said quadrant frame and hence said plow blade to translate to the right when viewed from above, and retracting said first actuator also causes said quadrant frame and hence said plow blade to translate to the left when viewed from above.

4. The assembly of claim 1 wherein both of said fifth and sixth pivot points are located outside a perimeter of the trapezoid.

5. The assembly of claim 4 wherein both of said fifth and sixth pivot points are located rearward of said first and third pivot points.

6. The assembly of claim 5 wherein said drive link includes a portion extending rearward from said first pivot point to said sixth pivot point.

7. The assembly of claim 1 further comprising:

a head gear adapted to be removably connected to the vehicle, said angle frame pivotally connected to said head gear for pivoting movement about a generally horizontal axis generally perpendicular to the longitudinal axis of the vehicle, and a second actuator operably connected to said head gear and said angle frame for raising and lowering said plow blade.

8. The assembly of claim 1 wherein said first actuator is a double acting hydraulic cylinder.

9. The assembly of claim 7 wherein said second actuator is a single acting hydraulic cylinder.

10. The assembly of claim 1 wherein the vehicle is an ATV or a UTV.

11. A snow plow assembly comprising:

an angle frame adapted to be operably mounted to a vehicle, a quadrant frame, a plow blade mounted to said quadrant frame, a first link pivotally connected to said angle frame and said quadrant frame at first and second pivot points, respectively, a second link pivotally connected to said angle frame and said quadrant frame at third and fourth pivot points, respectively, said angle frame, quadrant frame, first link, and second link, and said first, second, third, and fourth pivot points defining a four-bar linkage, said first link being pivotably fixable relative to said angle frame at a first position, a second position, and a third position, wherein when said first link pivots from the first position to the second position relative to said angle frame said quadrant frame and hence said plow blade rotate in a first direction from a neutral position generally perpendicular to a longitudinal axis of the vehicle, and when said first link pivots from the first position to the third position said quadrant frame and hence said plow blade rotate in a second opposite direction from the neutral position, wherein said angle frame, quadrant frame, first link, and second link, and said first, second, third, and fourth pivot points define a trapezoid when said quadrant frame and hence said plow blade are in the neutral position, wherein said first link is pivotably fixable relative to said angle frame at a location outside a perimeter of the trapezoid.

12. The assembly of claim 10 wherein:

when said first link pivots from the first position to the second position said quadrant frame and hence said plow blade translate in a first direction generally transverse to the longitudinal axis of the vehicle, and when said first link pivots from the first position to the third position said quadrant frame and hence said plow blade translate in a second opposite direction generally transverse to the longitudinal axis of the vehicle.

13. The assembly of claim 12 wherein:

when said first link pivots from the first position to the second position said quadrant frame and hence said plow blade rotate counter-clockwise from the neutral position when viewed from above, and when said first link pivots from the first position to the third position said quadrant frame and hence said plow blade rotate clockwise from the neutral position when viewed from above, and when said first link pivots from the first position to the second position said quadrant frame and hence said plow blade translate to the right when viewed from above, and when said first link pivots from the first position to the third position said quadrant frame and hence said plow blade translate to the left when viewed from above.

14. The assembly of claim 11 wherein the location is located rearward of said first and third pivot points.

15. The assembly of claim 14 wherein said first link includes a portion extending rearward from said first pivot point to the location.

16. The assembly of claim 11 further comprising:

a head gear adapted to be removably connected to the vehicle, said angle frame pivotally connected to said head gear for pivoting movement about a generally horizontal axis generally perpendicular to the longitudinal axis of the vehicle, and an actuator operably connected to said head gear and said angle frame for raising and lowering said plow blade.

17. The assembly of claim 16 wherein said actuator is a winch adapted to be mounted to the vehicle, said winch having a cable with a free end, said free end being connected to said angle frame, and said head gear having a pulley rotatably supporting said cable.

18. The assembly of claim 11 wherein the vehicle is an ATV or a UTV.

19. A snow plow assembly comprising:

an angle frame adapted to be operably mounted to a vehicle, a quadrant frame, a plow blade mounted to said quadrant frame, a first link pivotally connected to said angle frame and said quadrant frame at first and second pivot points, respectively, a second link pivotally connected to said angle frame and said quadrant frame at third and fourth pivot points, respectively, said angle frame, quadrant frame, first link, and second link, and said first, second, third, and fourth pivot points defining a four-bar linkage, said first link being pivotably fixable relative to said angle frame at a first position, a second position, and a third position, first means for pivoting said plow blade, quadrant frame, first link, and second link relative to said angle frame, wherein when said first link pivots from the first position to the second position relative to said angle frame said quadrant frame and hence said plow blade rotate in a first direction from a neutral position generally perpendicular to a longitudinal axis of the vehicle, and when said first link pivots from the first position to the third position said quadrant frame and hence said plow blade rotate in a second opposite direction from the neutral position, wherein when said first link pivots from the first position to the second position said quadrant frame and hence said plow blade translate in a first direction generally transverse to the longitudinal axis of the vehicle, and when said first link pivots from the first position to the third position said quadrant frame and hence said plow blade translate in a second opposite direction generally transverse to the longitudinal axis of the vehicle, a head gear adapted to be removably connected to the vehicle, said angle frame pivotally connected to said head gear for pivoting movement about a generally horizontal axis generally perpendicular to the longitudinal axis of the vehicle, and second means operably connected to said head gear and said angle frame for raising and lowering said plow blade, wherein said angle frame, quadrant frame, first link, and second link, and said first, second, third, and fourth pivot points define a trapezoid when said quadrant frame and hence said plow blade are in the neutral position, wherein said first link is pivotably fixable relative to said angle frame at a location outside a perimeter of the trapezoid.

20. The assembly of claim 19 wherein said first means is a double acting hydraulic cylinder and said second means is a single acting hydraulic cylinder.

21. The assembly of claim 19 wherein said first means is manual by an operator and said second means is a cable winch adapted to be mounted to the vehicle.

22. The assembly of claim 19 wherein the vehicle is an ATV or a UTV.

23. A snow plow assembly comprising:

an angle frame adapted to be operably mounted to a vehicle, a quadrant frame, a plow blade mounted to said quadrant frame, a drive link pivotally connected to said angle frame and said quadrant frame at first and second pivot points, respectively, a swing link pivotally connected to said angle frame and said quadrant frame at third and fourth pivot points, respectively, said angle frame, quadrant frame, drive link, and swing link, and said first, second, third, and fourth pivot points defining a four-bar linkage, and a first actuator pivotally connected on one end to said angle frame at a fifth pivot point and pivotally connected on the other end to said drive link at a sixth pivot point, wherein extending said first actuator causes said quadrant frame and hence said plow blade to rotate in a first direction from a neutral position generally perpendicular to a longitudinal axis of the vehicle, and retracting said first actuator causes said quadrant frame and hence said plow blade to rotate in a second opposite direction from the neutral position, wherein said angle frame, quadrant frame, drive link, and swing link, and said first, second, third, and fourth pivot points define a trapezoid when said quadrant frame and hence said plow blade are in the neutral position, wherein both of said fifth and sixth pivot points are located outside a perimeter of the trapezoid.

24. The assembly of claim 23 wherein at least one of said fifth and sixth pivot points is located rearward of said first and third pivot points.

25. The assembly of claim 23 wherein both of said fifth and sixth pivot points are located rearward of said first and third pivot points.

* * * * *